United States Patent [19]

Burandt

[11] Patent Number: 4,484,558

[45] Date of Patent: Nov. 27, 1984

[54] VARIABLE FUEL DELIVERY SYSTEM FOR INTERNAL COMBUSTION ENGINES

[75] Inventor: Corliss O. Burandt, Plymouth, Minn.

[73] Assignee: Investment Rarities, Incorporated, Minneapolis, Minn.

[21] Appl. No.: 492,015

[22] Filed: May 5, 1983

[51] Int. Cl.[3] ..... F02M 39/00

[52] U.S. Cl. ..... 123/452; 261/44 A

[58] Field of Search ..... 123/452–455, 123/507, 508, 90.16; 261/44 A, 50 A

[56] References Cited

U.S. PATENT DOCUMENTS

| | | | |
|---|---|---|---|
| 4,063,905 | 12/1977 | Johnson et al. | 261/44 A |
| 4,064,843 | 12/1977 | Holzbaur | 261/44 A |
| 4,102,952 | 7/1978 | Snipgs | 261/44 A |
| 4,149,562 | 4/1979 | Johnson et al. | 261/44 A |
| 4,184,466 | 1/1980 | Nagele | 123/455 |
| 4,348,999 | 9/1982 | Holzbaur et al. | 261/50 A |
| 4,414,948 | 11/1983 | Holzbaur | 261/50 A |

*Primary Examiner*—Magdalen Y. C. Moy

*Attorney, Agent, or Firm*—Peterson, Palmatier, Sturm, Sjoquist & Baker, Ltd.

[57] ABSTRACT

A pivotal air door or velocity blade provides a carburetor and injection action which transitionally changes back and forth in accordance with the door's angular position. The angular position of the air door or velocity blade is controlled by the movement of an upper rocker arm relative to a lower rocker arm. A cam unit acts on a contoured follower surface on the upper rocker arm, and the free end of the upper rocker arm acts against a contoured follower surface on the lower rocker arm, the lower rocker arm in turn acting on the inlet valve of an internal combustion engine.

18 Claims, 6 Drawing Figures

AIR CLEANER
A-A
B-B
2
6

A
B
10
12
14
16
18
20
22
24
26
28
30
32
34
36
38
40
50
52
54
56
58
60
62
68
70
72
76
78
80
82
84
86
88
90
92
94
96
98
100
101
102
104
106
108
110
112
114
118
120
122b
126
130
132
135
136
140
144
148
150
152
154
156
158
160
162
164
166
168
170
172
174
180

VARIABLE FUEL DELIVERY SYSTEM FOR INTERNAL COMBUSTION ENGINES

CROSS-REFERENCE TO RELATED APPLICATIONS

My co-pending application titled "Valve Actuating Apparatus Utilizing a Multi-profiled Cam Unit for Controlling Internal Combustion Engines", Ser. No. 378,843, filed on May 17, 1982 and now U.S. Pat. No. 4,459,946 contains subject matter related to this application.

BACKGROUND OF THE INVENTION

1. Field of the Invention

This invention relates generally to apparatus for controlling the delivery of fuel to an internal combustion engine, and pertains more particularly to a pivotal air door or velocity blade that possesses the desirable characteristics of both carburetion and injection devices for introducing fuel and air into a combustion chamber of an internal combustion engine via a reciprocable intake valve that is controlled as to both its lift and duration.

2. Description of the Prior Art

Air doors, or velocity blades as they sometimes are called, have been used previously, both in connection with carburetion and also in connection with fuel injection systems. Although air doors have functioned satisfactorily when used in fuel injection systems, the cost of an injection system is quite appreciable, and this has militated against any extensive use of such systems insofar as I am aware. Two examples of fuel injection systems utilizing air doors are found in U.S. Pat. Nos. 4,079,718, issued on Mar. 21, 1978 to Siegfried Holzbaur for "Fuel Injection System" and U.S. Pat. No. 4,134,379, issued on Jan. 16, 1979 to Gerhard Stumpp for "Fuel Injection System." The two patented systems operate on a fuel injection principle at all times.

Insofar as air doors having been used in association with carburetors and when they perform a venturi action, illustrations of such uses are contained in U.S. Pat. No. 1,611,347, issued on Dec. 21, 1926 to Albert E. Hartwell for "Carburetor" and U.S. Pat. No. 3,291,464, issued on Dec. 13, 1966 to Rudolph L. Hammerschmidt for "Carburetor Having Adjustable Precision Fuel Metering Means." These two patents, however, disclose carburetor arrangements that do not utilize therein fuel injection principles.

SUMMARY OF THE INVENTION

An important object of my invention is to provide a fuel delivery system that possesses the characteristics of both a carburetor device and a fuel injection device. More specifically, an aim of the invention is to provide a fuel delivery system that functions as a variable venturi carburetor under idle or light load conditions and graduates towards a fuel injection system under high performance or heavy load conditions. Thus, it is within the purview of my invention to provide a variable fuel delivery system that operates in a dual fashion, as just mentioned, so as to automatically supply fuel to the combustion chamber of an internal combustion engine when a relatively high vacuum condition exists within that chamber, as occurs during the intake stroke under idling or light load conditions, and which will progressively change to a fuel injection system when the load changes sufficiently and there is a greater demand for inducing fuel and air to flow into the combustion chamber. My system continuously changes back and forth from a carburetion mode to a fuel injection mode as load conditions dictate, the system also automatically adapting itself to a combined carburetion and injection system for intermediate loads.

Another object of the invention is to provide a variable fuel delivery system which is relatively inexpensive to manufacture, requiring no conventional carburetor or fuel injection devices. In this regard, an aim of the invention is to provide a fuel system that will deliver the performance of heretofore timed fuel injection, doing so either at the cost of carburetion or at a cost less than that of carburetion.

A further object is to provide a fuel system primarily intended for use in conjunction with an intake valve throttled internal combustion engine, but which can be used, when desired, with conventionally throttled engines.

Yet another object of the invention is to take advantage of the inherent capability of intake valve throttled systems to atomize fuel better than port fuel injection systems, liquid fuel with my invention being readily atomized under light load conditions by reason of the higher velocities, particularly when above a sonic level, transpiring when used with the intake valve throttled system with which my invention will find especial utility.

Still another object of the invention is that the combined carburetor and fuel injection techniques referred to above are of appreciable advantage when used in combination with a valve control mechanism capable of changing both duration and lift.

My invention also has for an object the avoidance of fuel delivery until a sonic velocity is potentially reached. In this regard, my invention recognizes that if the fuel can be delivered into the combustion chamber of cylinder in the later portion of the intake stroke when the piston is moving quickly, and hence at a time when residual suction does exist, then there is more opportunity for sonic velocities and hence better fuel vaporization.

Still another object of the invention is to utilize an air door or velocity blade as an accelerator pump or priming device for engine starting. My invention, owing to the positioning of the float chamber at a proper elevation with respect to the air door or velocity blade assures that when the air door is opened, that is, more horizontal than when the air door is closed, and the engine is not running, the more horizontal orientation of the air door will result in the fuel being discharged only gravitationally at the nozzle end of the air door because the nozzle end is under these circumstances lower than the float level.

The invention has for a further object the provision of a variable delivery fuel system that lends itself readily to being commanded by various mechanisms currently employed. More specifically, the invention envisages the use of a foot-operated accelerator control, acting either directly or via a suitable amplifier, for the air door and the valve control apparatus, the two being mechanically interlinked, or acting in conjunction with various electronic controls and servomechanisms that have evolved in recent times.

Briefly, my invention involves the utilization of a special intake valve throttled control apparatus that is instrumental in controlling both the lift and duration of valve opening. In this regard, the specific intake valve throttled control apparatus makes use of two rocker arms, each having a contoured cam follower surface. The upper of the two rocker arms has its cam follower surface located so that a cam unit mounted on a camshaft acts thereagainst, the free end of the upper rocker arm bearing against the free end of a second rocker arm that also has an appropriately curved or contoured cam follower surface. The pivot point of the upper rocker arm can be shifted so as to present various longitudinal portions of its contoured cam follower surface to the cam unit on the camshaft thereabove, the surface being moved with respect to the cam unit so as to change the effective moment arm of the upper rocker arm relative to the lower rocker arm. In this way the cam follower surface of the lower rocker arm is acted upon in dependence upon where the upper rocker arm is located at a given moment. The free end of the lower rocker arm acts against the stem of a conventional reciprocable intake valve to open the valve in accordance with position of the upper rocker arm relative to the lower rocker arm.

A combined carburetor and injection action is incorporated into the system by reason of an air door or velocity blade, the air door being pivotally mounted at its lower end within a portion of the induction passage leading to the intake valve and in close proximity with respect thereto. By mounting the float chamber at the proper elevation and feeding the fuel into the lower end of the air door, that is, its pivotally mounted end, the fuel does not leave the discharge or upper end of the air door when the door is substantially closed, which is when the discharge opening is uppermost. On the other hand, by reason of the appropriately selected elevation for the float chamber, when the air door is pivoted into an open or more horizontal position within the induction passage, fuel is permitted to flow gravitationally through the air door into the induction passage and hence into the combustion chamber through the port being controlled by the reciprocable intake valve.

The air door can be pivoted in unison with other air doors, it being contemplated that there be an air door for each combustion chamber or cylinder. Hence, when the engine is a four cylinder engine, four air doors would be utilized, one in each of four induction passages.

It is also planned that the upper rocker arm be shifted relative to the cam unit it underlies in an appropriately coordinated manner with respect to the pivotal position of the particular air door that controls the mixture of fuel and air being admitted into the combustion chamber. The invention provides for two lever arms, one lever arm extending angularly from the particular air door it is to angularly position and the other lever arm being pivotally mounted so as to influence the movement or shifting of the upper rocker arm. Interconnecting linkage between the two lever arms transmits motion so that the upper rocker arm is shifted with respect to the lower rocker arm, all in accordance with the particular angular or pivoted position of the air door.

DESCRIPTION OF THE PREFERRED EMBODIMENT

Inasmuch as my co-pending application titled "Valve Actuating Apparatus Utilizing a Multi-profile Cam Unit for Controlling Internal Combustion Engines" has herein been identified, reference can be made, if needed, to said co-pending application for additional details not fully set forth herein. At the outset, it will be mentioned that there are certain similarities between the embodiment herein being described and the embodiment described in my co-pending application. Nonetheless, in order to make the present application sufficiently self-contained and reasonably self-explanatory, at least to a degree that the reader may not have to resort to said co-pending application, the ensuing description will contain reference to a number of the parts comprising the invention described in my co-pending application.

Figures 1, 4, 5, 6:
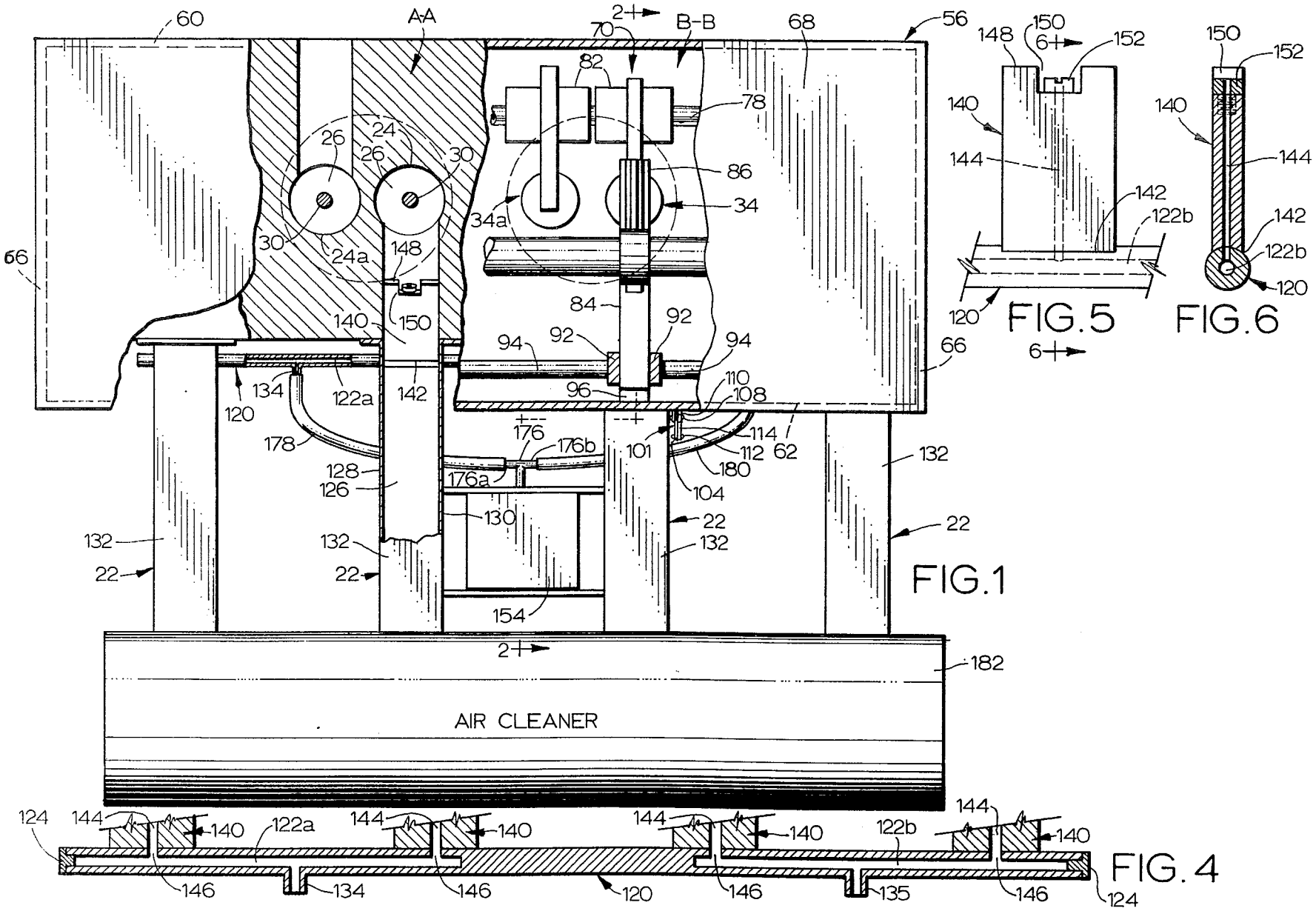
FIG. 1 is a top plan view of an internal combustion engine equipped with apparatus providing a variable delivery fuel system in accordance with my invention, structural portions being broken away so as to expose to view parts that are located at different elevations denoted as A—A and B—B.
FIG. 4 is a sectional detail illustrating the manner in which the various air doors are pivotally mounted, the view being taken in the direction of line 4—4 of FIG. 3.
FIG. 5 is an elevational view of one of the air doors, the view being taken in the general direction of line 5—5 of FIG. 2.
FIG. 6 is a sectional view taken in the direction of line 6—6 of FIG. 5.
Figure 2:
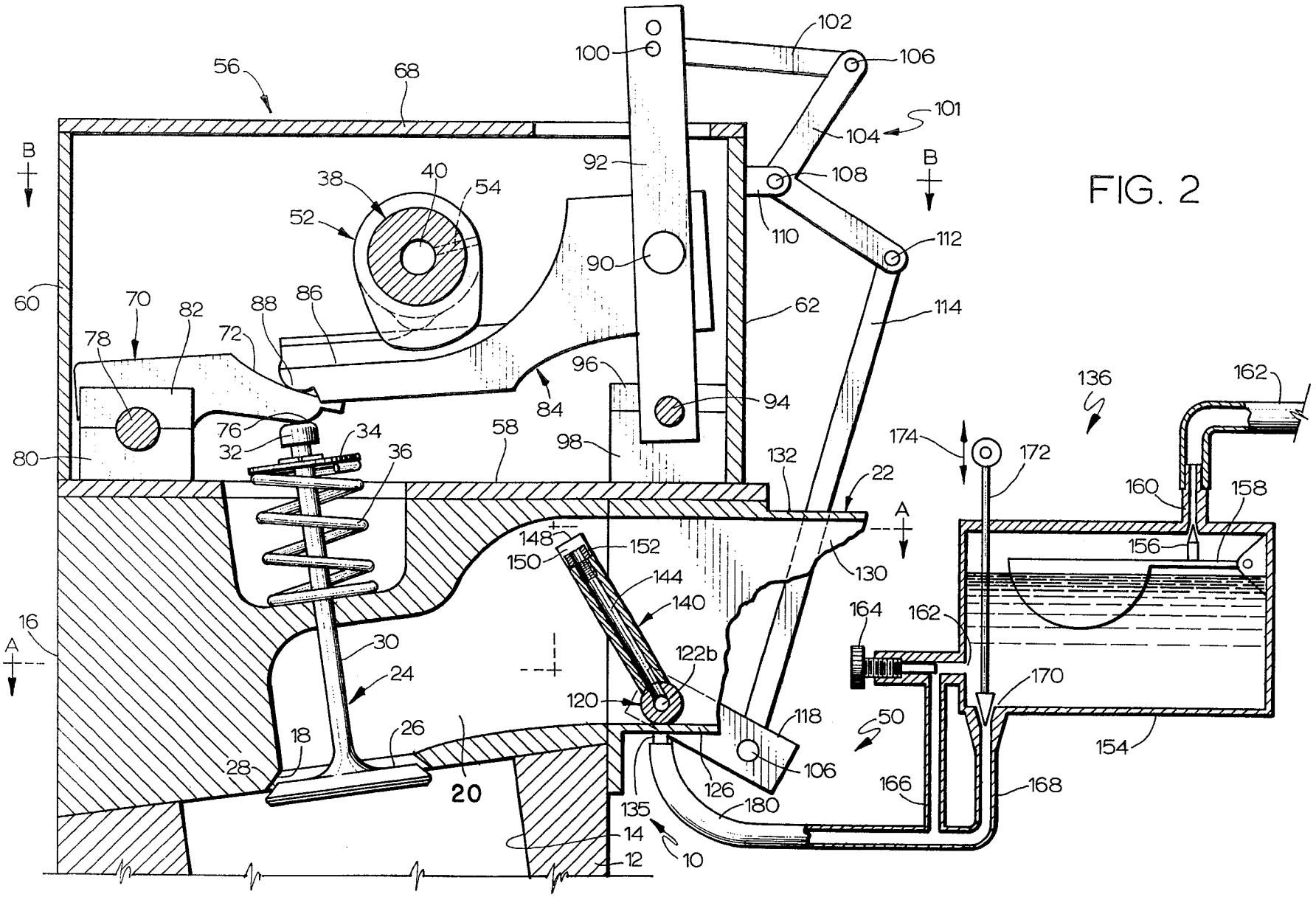
FIG. 2 is a side elevational view of an intake valve throttled control mechanism utilized with an air door mounted in juxtaposition relative to the float chamber that supplies fuel through the air door in a venturi fashion in that the air door in this instance is virtually closed, the view being taken generally in the direction of line 2—2 of FIG. 1 and denoting the elevations A—A and B—B appearing in FIG. 1.
Figure 3:
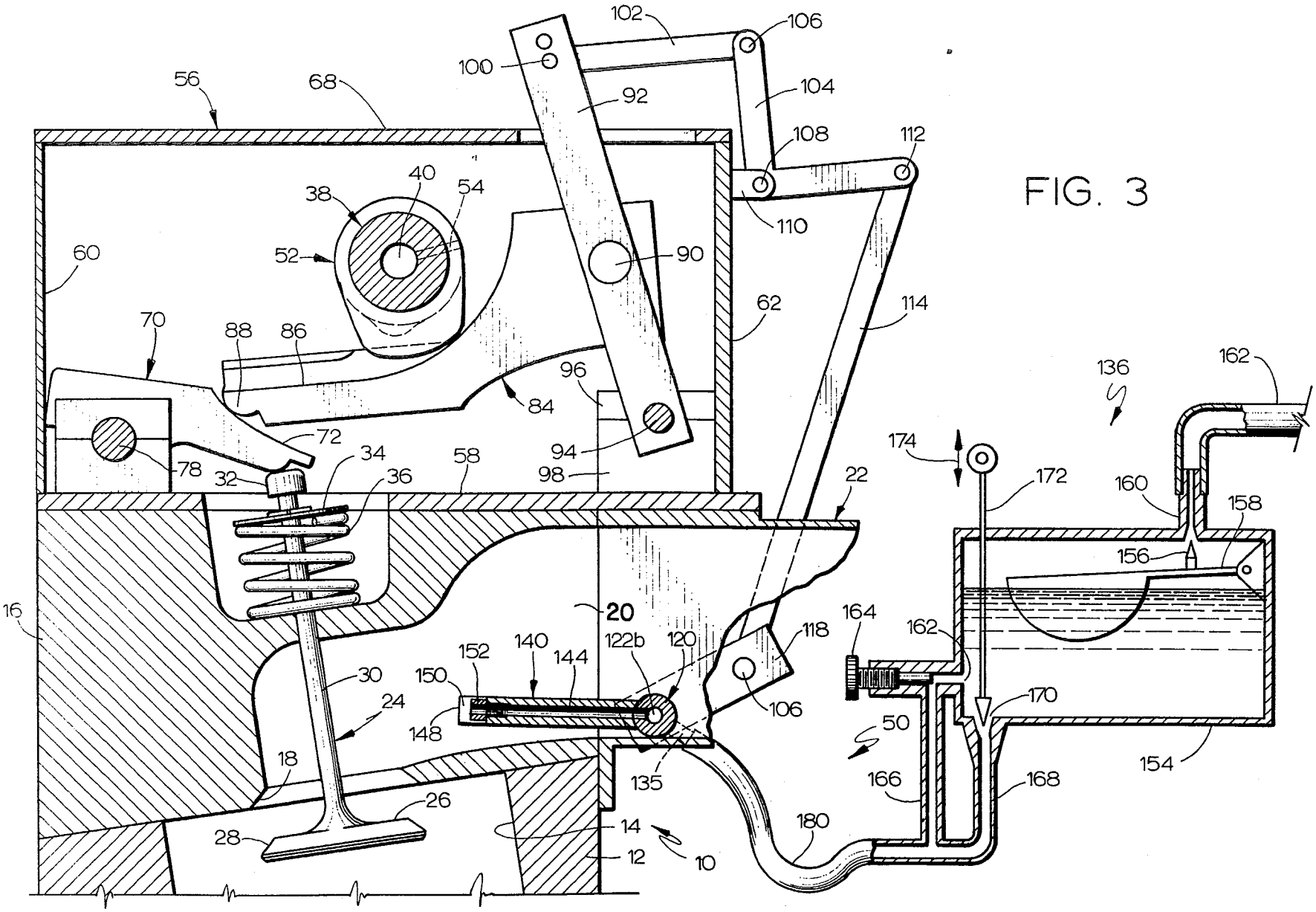
FIG. 3 is a view corresponding to FIG. 2 but with the intake valve open to a greater degree than in FIG. 2 and illustrating the air door angularly positioned so as to be open rather than closed as in FIG. 2, the air door in this instance functioning as a fuel injection device in contradistinction to functioning as a carburetor device as in FIG. 2.

With the above in mind, a conventional internal combustion engine 10 has been fragmentarily depicted in FIGS. 1, 2 and 3. The engine 10 includes a cylinder block 12 containing any number of combustion chambers or cylinders 14, two having been depicted in phantom outline insofar as FIG. 1 is concerned but only one combustion chamber 14 appearing in FIGS. 2 and 3. Associated with the cylinder block 12 is a cylinder head 16 which has formed therein an inlet valve port 18 having an induction passage 20 connecting with one of the induction pipes 22, there being one induction passage 20 and one induction pipe 22 for each cylinder 14. It will be observed that the bottom of the induction passage 20 slopes downwardly from the induction pipe 22 to the port 18 for a reason hereinafter given.

Conventionally included is an inlet valve indicated generally by the reference numeral 24. More specifically, the inlet valve 24 includes a head 26 having a beveled upper edge 28 that effectively closes the inlet port 18 when the valve 24 has moved sufficiently upwardly. The valve 24 further includes a stem 30 having a lash cap 32 mounted on its upper end. A retainer 34 maintains a coil spring 36 captive so that the valve 24, that is, its head 26, is biased upwardly into a closed or seated position when not forced open.

Connected in a conventional manner to the crankshaft (not shown) is a camshaft 38. In this instance, the camshaft 38 is tubular, having a passage or bore 40 extending therethrough so that oil can be transmitted for lubricating purposes. Even though the parts just referred to are conventional and also shown in my said co-pending application, nonetheless it has been thought important to show and describe a sufficient number of parts belonging to the engine 10 in order that the operation of my hereinafter described variable fuel delivery system, which has been denoted generally by the reference numeral 50, can be better understood. It will be observed that the system 50 comprises a cam unit or eccentric assembly indicated by the reference numeral 52, the cam unit 52 being fixedly carried on the camshaft 38 for rotation therewith. The hollow or tubular configuration of the camshaft 38 has been referred to so it should now be noted that there is an oil hole or passage 54 provided in the cam unit 52 which hole or passage 54 connects with the bore 40 so that oil will be discharged radially outward through the hole 54 onto parts presently to be referred to.

Inasmuch as the cam unit 52 plays a very important role in realizing the objects of the invention set forth in my said co-pending application and is fully described in said application, the cam unit 52 will not be described in any great detail herein.

Although not actually important to a practicing of the present invention, nonetheless for the sake of completeness attention is now called to a valve cover or housing denoted in its entirety by the reference numeral 56. The valve cover 56 includes a horizontal bottom wall 58, upstanding side walls 60 and 62, end walls 64 and 66, as well as a removable lid 68. It is believed that the inclusion and identification of the various walls constituting the valve cover or housing 56 will enable the reader to visualize better the various parts made visible in FIG. 1. In this regard, the lid 68 has been broken away in FIG. 1 over a substantial area and a portion of the bottom wall 58 has also been broken away, the view there appearing actually being along the line A—A of FIG. 2, whereas that portion just to the left of the remaining portion of lid 68 at the right in FIG. 1 involves an unbroken section of the bottom wall 58, the view, in effect, being taken in the direction of line B—B in FIG. 2. These two different levels have been labeled A—A and B—B in FIG. 1, appropriate arrows extending to the portions that are seen at the levels A—A and B—B of FIG. 2.

At this time, attention is directed to a lower rocker arm denoted by the reference numeral 70. The rocker arm 70 is formed with a ramp section 72 that curves upwardly from the right, as can be seen from FIGS. 2 and 3. Integral with the underside of the right end of the rocker arm 70 is a rounded nub 76 that engages the lash cap 32 at the upper end of the valve stem 30. The lower rocker arm 70 is mounted for pivotal movement on a shaft 78 providing a fixed axis; the shaft may be tubular. The shaft 78 is clamped in place by reason of blocks 80 and 82 having hold-down bolts (not shown) which anchor the blocks 80, 82 to the underlying bottom wall 58 of the valve cover 56. It will be appreciated that the bottom wall 58 in turn is anchored securely to the upper side of the head 16. As will be discerned from FIG. 1, there are two sets of the blocks 80, 82, the lower rocker arm 70 being pivotally mounted on the shaft 78 intermediate the two pairs of blocks 80, 82 at each side which prevent laterally shifting of the rocker arm 70 along the shaft 78. As can be perceived from FIGS. 2 and 3, the rocker arm 70, which has the rounded nub 76 thereon, is instrumental in acting against the lash cap 32 so as to open the valve 24, and to also permit the valve 24 to close under the influence of its coil spring 36 when the nub 76 moves sufficiently upwardly.

Whereas FIGS. 2 and 3 show only a single inlet valve 24, it will be appreciated that inasmuch as FIG. 1 shows in phantom outline two combustion chambers of cylinders 14, then there are two such inlet or intake valves 24. However, for the sake of completion, it will be well to show adjacent to the intake valve 24 in FIG. 1 an exhaust valve which has been labeled 24*a* in order to enable it to be distinguished from the intake valve 24. By the same token, inasmuch as the retainer 34 appears in FIG. 1 which retainer is associated with the inlet valve 24, it will be well to label the retainer for the exhaust valve with the reference numeral 34*a*. Once again, it will be recognized that the portion of FIG. 1 labeled A—A is at a lower elevation, being sufficiently low so as to reveal the inlet valve head 26, whereas the portion just to the right which has been indicated as B—B depicts just the retainers 34 and 34*a* for the valves 24 and 24*a*, respectively.

Reference will be made at this time to an upper rocker arm 84 having a composite ramp section indicated generally by the reference numeral 86 and which functions as a cam follower surface. It will be noted that the left or free end of the upper rocker arm 84 is formed with an integral rounded or semicircular pad 88 which bears against whatever portion of the ramp section 72 on the lower rocker arm 70 it overlies. Inasmuch as reference can be made to my said co-pending application for additional details, the stepped configuration of the ramp section 86 formed on the upper rocker arm 84 will not be herein described other than to say that the stepped configuration complementally corresponds to that of the cam unit 52.

The end of the upper rocker arm 84 remote from the end thereof having the rounded pad 88 is pivotally carried or mounted on a relatively short shaft 90, the ends of the shaft 90 being mounted in parallel strips or lever arms 92. The lower ends of the lever arms 92 are pivotally mounted on a shaft 94 clamped in blocks 96 and 98 by means of hold-down bolts (not shown) that extend into the bottom wall 58 of the valve cover 56 in the same manner as do the hold-down bolts for the blocks 80 and 82. Disposed between the lever arms 92 and at the upper ends thereof is a pin 100 that pivotally connects one end of a generally horizontal link 102 to the lever arms 92. The other end of the link 102 is pivotally connected to the upper end of a bell crank denoted generally by the reference numeral 104 by means of another pivot pin 106. The bell crank 104 is pivotally mounted by reason of a pin 108 that is supported in a clevis 110 extending from the side wall 62 of the valve cover 56. The horizontal leg of the bell crank 104 has at its free end another pin 112 to which the upper end of a generally vertical link 114 is pivotally attached. The lower end of the link 114 has a pivot pin 116 which connects this lower end to a pair of arms 118 that are integral with a tubular shaft denoted generally by the reference numeral 120.

From FIG. 4, it will be discerned that the tubular shaft 120 has bore portions 122*a* and 122*b*, the ends of these bore portions 122*a*, 122*b* being closed by plugs 124. The shaft 120 is journaled for rotation in the various earlier-mentioned induction pipes 22 through which the shaft 120 extends. It may help to explain at this stage that each induction pipe 22 includes a bottom wall 126, side walls 128, 130 and a top wall 132, thereby providing a duct or passage having a rectangular cross section, the vertical dimension or height of which is greater than its horizontal dimension or width. Height becomes a design factor with respect to achieving a desired amount of fuel enrichment via actuation of the air door or velocity blade presently to be referred to. The bore portions 122*a*, 122*b* within the tubular shaft 120 have nipples 134 and 135 that connect with a source of fuel denoted generally by the reference numeral 136 which source of fuel 136 will be described more fully hereinafter.

At this time, reference will be made to a plurality of air doors or velocity blades 140 that are fixedly attached to longitudinally spaced portions of the tubular shaft 120. All four air doors or velocity blades 140 have portions thereof appearing in FIG. 4. However, only one air door or velocity blade 140 has been shown in FIG. 1, this same air door 140 appearing in FIGS. 2 and 3 as well (but in different angular positions). Still further, a single air door 140 has been illustrated in FIGS. 5 and 6. While the air door 140 is in the form of a rectangular plate, as is clearly evident from FIGS. 5 and 6, it is to be observed that the lower edge 142 thereof is concave so that it fits against the tubular shaft 120. Actually, the edge 142 of the air door or velocity blade 140 is fixedly secured to the shaft 120, such as by welding, and by virtue of a passage or bore 144 extending centrally through the door 140 from a radially directed hole 146 (there being one such hole 146 for each of the four doors 140 in FIG. 4) in the shaft 120, fuel can be supplied from the bore portions 122*a*, 122*b* through the doors 140 into the various induction passages 20, one of which is shown in FIGS. 2 and 3. The manner in which the fuel is discharged from the air doors 140 is described immediately below.

It will be observed from FIG. 5 that the free edge 148 of the door 140 there appearing has a notch 150 formed therein. The notch 150 is provided with a nozzle 152 which is threaded into the free edge 148, which constitutes the upper end of the door 140 in FIG. 2, so as to provide a discharge orifice via which fuel is discharged. As is readily discernible from FIG. 1, the width of the air door or velocity blade 140 corresponds to the width of the induction pipe 22 in which it is located, and also with the width of the earlier-mentioned passage 20 leading to the port 18 with which the valve member 24 coacts. In other words, the distance between the side edges of the air door 140 extend from one side wall 128 to the other side wall 130 of the pipe 22, the door 140 being capable of relative pivotal movement between these side walls 128, 130.

Inasmuch as the lever arms 118 are integral with the tubular shaft 120, it follows that when the tubular shaft 120 is angularly rotated from the position in which it appears in FIG. 2, this being with the air door or velocity blade 140 in a substantially closed position, to a position corresponding to that depicted in FIG. 3, this being in which the air door or velocity blade 140 is fully open, it will be seen that the lever arms 118 shift angularly from a lower position (just below the 3:00 o'clock position) in FIG. 2 to an upper position in FIG. 3 (just above the 3:00 o'clock position). Owing to the linkage connecting the lever arms 92 with the lever arms 118, acting through the medium of the bell crank 104, it can be appreciated, it is believed, that the arms 92 are shifted angularly and that the shaft 90 carried intermediate their ends to which the upper rocker arm 84 is pivoted is likewise shifted so as to change the position of the cam follower ramp 86 against which the cam unit 52 bears as it rotates.

At this stage of the description, it can be explained that when the air door or velocity blade 140 is in the position in which it appears in FIG. 2, then it is intended that fuel be drawn through the orifice or nozzle 152 by reason of the induction that takes place when the valve 24 is forced open and the piston (not shown) in the combustion chamber or cylinder 14 is moving downwardly. On the other hand, when the air door or velocity blade 140 is fully open, this being the horizontal position thereof pictured in FIG. 3, then it is intended that the fuel flow be gravitationally into the passage 20 (increased when the valve 24 opens during the intake stroke). It will be recognized that the passage 20 is deliberately made quite short and that the orifice or discharge end 148 of the air door or velocity blade 140 is such that it gravitationally dispenses or delivers the fuel in close proximity to the port 18 and hence to the valve member 24, the nozzle 152 being slightly above the valve port or seat 18. It has already been mentioned that the bottom or lower wall of the passage 20 slopes downwardly to the port 18. The reason for having this declination is to avoid any objectionable accumulation of fuel within the passage 20. One thing that should be noted is that the notch 150 in the free end of the air door or velocity blade 140 assures that the air coming through the induction pipe 22 into the passage is never blocked completely irrespective of the angular position of the air door 140.

Inasmuch as the angular position of the air door or velocity blade 140 influences how the fuel is delivered into the passage 20 and hence into the combustion chamber or cylinder 14, it is important that the air door 140 in each instance be appropriately supplied with fuel in a manner such as to achieve the sought after results. Thus, it will be seen that a float chamber or bowl 154 has been illustrated in FIGS. 1, 2 and 3. From FIGS. 2 and 3, it will be observed that there is a needle valve 156 mounted on a float arm 158 that coacts with a seat 160 so as to control the admission of liquid fuel into the chamber or bowl 154 depending upon the position of the float arm 158. Of course, the needle valve 156, more specifically its seat 160, is connected to a fuel pump (not shown) through the agency of a tube 162 having communication with the pump and which connects with the fuel chamber 154 adjacent the needle valve 156.

The fuel chamber or bowl 154 has an outlet 162 near its bottom. An adjustable fuel valve 164 is employed so that the fuel exiting from the chamber 154 through the outlet 162 can be controlled, especially for idling conditions, so that the proper amount of fuel flows downwardly through a vertical tube 166. In parallel with the vertical tube 166 is still another tube 168 which has communication with an outlet 170 directly in the bottom of the fuel chamber, which outlet 170 is controlled by a metering rod 172 that is moved upwardly or downwardly in the direction of the double headed arrow 174. The metering rod 172 allows for external inputs for fuel enrichment needed for the choke circuit and the power circuit. Adjusting the stationary stop (not shown) of the metering rod 172 provides an idle mixture control (in conjunction with the adjustable valve 164), or a separate bypass circuit can be utilized.

The two vertical tubes shown in FIGS. 2 and 3 connect with a T-shaped fitting 176 having horizontal legs 176*a*, 176*b* extending in opposite directions. The one leg 176*a* has a flexible hose or tube 178 connecting thereto and leading to one of the previously mentioned nipples 134 on the tubular shaft 120, whereas the other leg 176*b* of the T-shaped fitting 176 has a similar flexible tube or hose 180 extending to the other nipple 135 appearing in FIG. 4.

As can be learned from FIG. 1, an air cleaner or air manifold 182 supplies filtered air into each of the induction pipes 22. As can be understood from FIG. 2, the closed, or substantially closed, position of the air door or velocity blade 140 substantially increases air-fuel velocity through the small opening communicating with the combustion chamber of cylinder 14. On the other hand, when the air door or velocity blade 140 assumes a horizontal position, as shown in FIG. 3, then the flow of air is virtually unrestricted and a much greater air flow can be realized when the intake valve 24 is fully opened. Thus, the intake valve 24 is only slightly open in FIG. 2 and since the air door or velocity blade 140 is virtually closed, during the intake stroke of the piston (which has not been illustrated) a substantial reduced pressure or vacuum is created which causes fuel to be withdrawn from the discharge or free end of the air door or velocity blade 140. Stated somewhat differently, the fuel is literally sucked out of the discharge orifice or nozzle 152 into the combustion chamber 14.

Quite the contrary situation develops when the air door or velocity blade 140 is in its horizontal position, this being the position in which it appears in FIG. 3, for then the fuel is permitted to flow gravitationally through the passage 144 and out through the discharge orifice or nozzle 152 of the air door 140, accompanied by a substantial increase in air flow over and above the amount passing the air door 140 when substantially closed, as in FIG. 2.

Once again, comparison of FIGS. 2 and 3 will demonstrate that the angular position of the air door or velocity blade 140 is coordinated with the position of the upper rocker arm 84, this being achieved via the linkage comprised of the members 92, 104, 114 and 118. More specifically, when the air door or velocity blade 140 is in the substantially closed position shown in FIG. 2, then the cam unit 52 bears against the ramp portion 72 at a location such as to only open the valve 24 to the extent shown in FIG. 2. Thus, a degree of vacuum exists under these conditions, producing a venturi action by means of the air door or velocity blade 140 because fuel contained in the float chamber 154 is not permitted, owing to the height of the float chamber 154 in relation to the door 140, to pass through the air door 140 gravitationally. More specifically, the fuel in the passage 144 extending through the air door 140 can only seek a level corresponding to the level of the fuel 140 contained in the float chamber 154 until the intake valve opens and draws the fuel out of the velocity blade 140.

On the other hand, when the upper rocker arm 84 has been shifted into the position shown in FIG. 3, then the valve member 24 is not only open to a greater degree, as is evident from this particular figure, but is held open longer. In other words, both the lift (the amount of valve opening) and duration (the time in which the valve is held open) are increased. With the air door or velocity blade 140 in substantially a horizontal position and the level of the fuel in the float chamber 154 substantially higher than the nozzle 152, a static head causes the fuel to flow gravitationally through the outlet 162 (and the outlet 170 if it is open) into the T-shaped fitting 176 and then through the flexible hoses 178, 180 to the tubular shaft 120, and thence into each of the air doors 140 associated with the tubular shaft 120, the fluid connection of the air doors 140 with the bores 122*a*, 122*b* formed in the tubular shaft 120 best being understood from FIG. 4.

Although it is believed obvious from the description that has been given, nonetheless, it will be well to emphasize that at idle, or light load condition, of the engine 10, the free end of the air door or velocity blade 140 is higher than the level of the fuel contained in the float chamber 154 so that there will be no fuel delivery whatsoever to the engine 10 unless there is an intake stroke caused by the downward movement of the piston in the combustion chamber or cylinder 14 which creates a pressure differential at the orifice or nozzle 152 at the upper or free end 148 of the air door 140, particularly by virtue of the notch 150 centrally formed in the free end 148 of each air door 140. Thus, where an intake stroke occurs and the intake valve 24 is open, even though only slightly as shown in FIG. 2, it follows that the fuel will be induced to pass through the passage 144 of the air door or velocity blade 140 only by virtue of the reduced pressure created by the descending piston in the combustion chamber or cylinder 14. It must be borne in mind that when there is no suction, there is no fuel delivery, and that there is only suction during the time when the intake valve 24 is open. During the foregoing, while functioning as a carburetor, an action closely resembling timed fuel injection is created. Whereas the fuel is pulled into the combustion or cylinder 14 only under vacuum conditions, and only when the valve 24 is open, the lesser opening, this being because only a small amount of fuel is needed, produces an excellent atomization in the cylinder 14 of the fuel with the air that has been drawn in with the fuel.

Once again, it is important to note that the position of the upper rocker arm 84 with respect to the camshaft 38, and hence to the cam unit 52, is coordinated with the angular movement of the tubular shaft 120. Stated somewhat differently, there is a direct and positive relationship between the opening of the valve 24 and the degree of venturi opening caused by the air door 140. It should be appreciated that the fuel is only launched, so to speak, toward the intake valve 24 where it is atomized as it passes between the port or seat 18 and head 26. The fuel delivery system 50 herein disclosed is only responsible for delivering the correct amount of fuel to each of the cylinders or combustion chambers 14. The vaporization and throttling control are accomplished by the intake valve 24. The opening of the intake valve 24, it will be understood, can begin well past top dead center of the piston, thereby providing a mechanical fuel timing control in conjunction with the fuel system control.

Considering now a condition at higher speeds and increased loads, it is then that the air door or velocity blade 140 is lowered into the position in which it appears in FIG. 3. The free end 148 of the blade 140 now has its discharge nozzle 152 lower than that of the level of fuel within the fuel chamber or bowl 154. Consequently, when the intake stroke occurs, as it does when the piston begins to descend, there is a form of fuel injection, for the venturi action is not the only factor influencing fuel delivery. Instead, the fuel from the chamber or bowl 154 flows gravitationally into the passage 120 (the flow rate, of course, increasing substantially during the intake stroke after the valve 24 opens) and is injected, so to speak, through the port 18 into the combustion chamber or cylinder 14 when the valve 24 opens. Consequently, my system 50 literally changes from a carburetion mode to a fuel injection mode, the latter occurring when the air door or velocity blade 140 shifts its discharge nozzle 152 below that of the fuel level so that fuel flows freely into the cylinder 14 by gravity action when the valve 24 is open. However, even though a fuel injection operation is derived under these circumstances, the cost of providing such an action is relatively insignificant compared to conventional injection systems with which I am familiar. In any intake valve-throttled engine utilizing individually separated or isolated intake runners, each containing therein a variable venturi fuel delivery system, the timed fuel delivery at idle and light load produces a self-induced feature, a feature also inherent in my invention. Actually, I provide a variable timing fuel injection system at no increase in cost.

As far as the injection action is concerned, it should once again be kept in mind that the position of the air door or velocity blade 140 is coordinated with the upper rocker arm 84, this being through the agency of the link 114 and those members connected thereto.

While the arms 92, 118 have been interconnected with a simplified linkage, and certainly other means of transmitting forces from one pair of arms to the other can be adopted depending upon design circumstances, it should be appreciated that either the arms 92 or the arms 118 can be actuated because actuation of one pair of arms controls the movement of the other pair. Hence, irrespective of which arms 92 or 118 are the command arms and which ones are the slave arms, there is the interrelated and coordinated interaction that takes place so that my overall system indeed provides an optimum engine operation under various engine loads.

Although not herein depicted, it can be appreciated that the accelerator pedal of a vehicle (when my system 50 is installed on a vehicle) can be connected to either the arms 92 or the arms 118. Actually, in my co-pending application, the accelerator pedal is connected to a hydraulic amplifier and the hydraulic amplifier is in turn connected to the upper ends of arms that correspond to the arms 92 herein depicted. On the other hand, various automatic servomechanisms can be used, connected either to the lower arms 118 or the upper arms 92, depending upon available space and other circumstances. Likewise, various mechanisms can be employed for interconnecting the arms 92 and 118, all as previously indicated to be possible.

Having presented the foregoing description, it should be taken into account that the fuel injection that takes place when the air door or velocity blade 140 is substantially horizontal, as in FIG. 3, the fuel injection that occurs is in the passage 20 and through the inlet port 18 and not directly into the combustion chamber or cylinder 14, as is the case with direct fuel injection. This is a very desirable feature in that the injection takes place externally of the combustion chamber or cylinder 14 and one need not be concerned with high pressure and temperature precautionary measures that must be taken where the fuel is injected directly into the combustion chamber or cylinder 14.

Another benefit to be derived from a practicing of my invention is that the air door or velocity blade 140 becomes, in effect, an accelerator pump for use when starting the engine 10. If the air door or velocity blade 140 is open, that is, in the position in which it has been illustrated in FIG. 3, and when the engine 10 is not yet running, the fuel from the chamber or bowl 154 will be discharged through the nozzle 152 of the air door 140 because the nozzle 152 is then lower than the float level in the chamber 154. The amount of priming derivable this way would be determined by the time of activation rather than the number of strokes required when relying on conventional accelerator pump technology.

I claim:

1. A variable fuel delivery system for an internal combustion engine having a camshaft, a cam on said camshaft and a reciprocable valve member for opening and closing a port in communication with a combustion chamber of the engine, the system comprising means providing an induction path or passage having a horizontal portion for delivery of fuel and air to said combustion chamber via said valve member, an air door pivotally mounted in said horizontal portion of said passage means for movement in said horizontal portion between a substantially closed position in which said pivotal door member is more vertical and a substantially open position in which said door member is more horizontal, a nozzle located adjacent the free end of said door member, passage means leading to said nozzle for supplying fuel to said nozzle, and chamber means for supplying fuel to said passage means for flow to said nozzle, said chamber means being mounted at an elevation relative to said door so that when said door is in its said substantially closed position said nozzle is above the level of fuel in said chamber means so that fuel is prevented from being gravitationally discharged through said nozzle, and when said door is in its said substantially open position, said nozzle is below the level of fuel in said chamber means so that fuel is permitted to gravitationally flow through said passage means and be discharged through said nozzle.

2. A fuel delivery system in accordance with claim 1 including shiftable means for transmitting an opening force to said reciprocable valve member, and means interconnecting said door to said shiftable means for positioning said shiftable means in a coordinated relation with said door.

3. A fuel delivery system in accordance with claim 2 in which said shiftable means includes a curved cam follower surface against which said cam acts for determining the valve lift and valve duration of said valve member in accordance with the shifted position of said shiftable means.

4. A fuel delivery system in accordance with claim 3 in which said shiftable means includes a rocker arm, said curved cam follower surface being on said rocker arm, a first lever arm to which one end of said rocker arm is pivotally connected, a second lever arm connected to said door member, and means extending between said lever arms for transmitting movement between said first and second lever arms to shift said rocker arm in a direction to change said valve lift and valve duration and thus provide the coordinated relationship between the movement of said arms.

5. A fuel delivery system in accordance with claim 4 including a second rocker arm, means pivotally mounting said second rocker arm at a location so that the free end of said first rocker arm bears against the free end of said second rocker arm, and the free end of said second rocker arm in turn bears against said valve member.

6. A fuel delivery system in accordance with claim 5 in which said second rocker arm has a curved surface extending from its said free end in a direction toward its pivotally mounted end and the curved surface of said first rocker arm extends from its said free end toward its pivotally mounted end.

7. A fuel delivery system for an internal combustion engine having a camshaft, a cam unit on said camshaft and a reciprocable valve member for opening and closing a port in communication with a combustion chamber of the engine, the system comprising an induction pipe having a bottom wall, an upper wall and side walls providing a generally rectangular cross section, generally horizontal passage means providing communication between said induction pipe and said port, an air door having a rectangular configuration corresponding generally to the rectangular cross section of said induction pipe, said air door having an passage or bore extending therethrough from one end to the other end, means for pivotally mounting said one end of said door member adjacent the bottom wall of said induction pipe so that the other end of said door can be swung from a substantially vertical position into a substantially horizontal position, means for supplying fuel to said passage or bore adjacent said one end of said door so that fuel is induced to flow into said combustion chamber by venturi action when said door is substantially vertical and to be injected into said combustion chamber when said door is substantially horizontal, and means supplying air to said induction pipe so that air is drawn into said combustion chamber through said passage means and port when said valve member is open, the amount of air and fuel being delivered into said combustion chamber being dependent upon the position of said door and valve member.

8. A fuel delivery system in accordance with claim 7 in which said fuel supplying means includes a chamber and a tube extending from said chamber to said passage or bore adjacent said one end of said door so that fuel does not flow through said passage or bore into said passage means when said door is substantially vertical and in which fuel gravitationally flows through said passage or bore when said door is substantially horizontal.

9. A fuel delivery system in accordance with claim 8 including a float arm in said chamber, said float arm having a needle valve associated therewith for controlling the flow of fuel into said chamber so as to maintain the level of fuel in said chamber at a relatively constant elevation with respect to said one end of said door.

10. A fuel delivery system in accordance with claim 9 in which said other end of said door is at an elevation somewhat higher than said port when said door is substantially horizontal but lower than the fuel contained in said chamber.

11. A fuel delivery system in accordance with claim 10 in which said door has a notch in its said other end for permitting at least some air to flow past said other end of the door when said door member is substantially vertical.

12. A fuel delivery system in accordance with claim 11 including means for actuating said valve member, and means interconnecting said door with said valve actuating means so as to coordinate the opening of said valve with the opening of said door.

13. A fuel delivery system in accordance with claim 12 in which said valve actuating means controls both the lift and duration of the opening of said valve member.

14. A fuel delivery system for an internal combustion engine having a camshaft, a cam unit on said camshaft and a generally vertical reciprocable valve member for opening and closing a port in communication with a combustion chamber of the engine, the system comprising duct means for conveying air to said combustion chamber via said port when said valve member is open, an air door pivotally mounted in said duct means for supplying fuel into said duct means in a carburetor manner when said door member is in one position and supplying fuel to said combustion chamber in an injection manner when said door member is in a second position, and means for actuating said valve member in relation to the position of said door so as to cause said valve member to be opened by said cam unit in a predetermined relationship with respect to the position of said door.

15. A fuel delivery system in accordance with claim 14 in which said valve member is disposed for substantially vertical reciprocable movement and said duct means provides a generally horizontal surface at an elevation slightly above said port so that fuel flows gravitationally from said air door into said combustion chamber via said port when said door is in its second position and said fuel is drawn in a venturi manner into said combustion chamber when said door member is in its first position.

16. A fuel delivery system in accordance with claim 15 in which there is a number of said combustion chambers, and respective duct means for each of said chambers, and an air door in each of said duct means, and means for pivotally mounting each of said doors for pivotal movement in unison with each other.

17. A fuel delivery system in accordance with claim 16 in which fuel is supplied to said duct means from a float-operated bowl, said bowl being at an elevation so as not to have fuel flow through said door when said door is in its first position and to cause fuel to gravitationally flow through said door when said door is in its second position.

18. A fuel delivery system in accordance with claim 17 in which each of said valve members includes means associated there for changing the lift and duration thereof, and means interconnecting said doors so that said valve lift and valve duration changing means is changed in a coordinated relation with the positions of said various doors.

* * * * *